United States Patent [19]

Yoda et al.

[11] 4,222,798

[45] Sep. 16, 1980

[54] METHOD OF MANUFACTURING FERROMAGNETIC METAL POWDER

[75] Inventors: Minoru Yoda, Saku; Yasumichi Tokuoka, Komoro, both of Japan

[73] Assignee: TDK Electronics Company Limited, Tokyo, Japan

[21] Appl. No.: 20,144

[22] Filed: Mar. 13, 1979

[30] Foreign Application Priority Data

Mar. 14, 1978 [JP] Japan ..... 53-28205

[51] Int. Cl.[2] ..... H01F 1/02

[52] U.S. Cl. ..... 148/105; 75/0.5 AA; 148/126; 427/127

[58] Field of Search ..... 75/0.5 AA; 148/105, 148/126; 427/127

[56] References Cited

U.S. PATENT DOCUMENTS

| | | | |
|---|---|---|---|
| 3,206,338 | 9/1965 | Miller et al. | 148/105 |
| 3,535,104 | 10/1970 | Little et al. | 75/0.5 AA |
| 3,726,664 | 4/1973 | Parker et al. | 75/0.5 AA |
| 3,964,939 | 6/1976 | Chandross et al. | 75/0.5 AA |
| 3,977,985 | 8/1976 | Umeki et al. | 148/105 |
| 4,020,236 | 4/1977 | Aonuma et al. | 75/0.5 AA |
| 4,063,000 | 12/1977 | Aonuma et al. | 75/0.5 AA |
| 4,096,316 | 6/1978 | Tamai et al. | 75/0.5 AA |
| 4,097,313 | 6/1978 | Tokuoka et al. | 75/0.5 AA |

FOREIGN PATENT DOCUMENTS

| | | |
|---|---|---|
| 35-3862 | 4/1960 | Japan . |
| 35-12910 | 9/1960 | Japan . |
| 36-3860 | 4/1961 | Japan . |
| 36-11412 | 7/1961 | Japan . |
| 36-22230 | 11/1961 | Japan . |
| 38-20520 | 10/1963 | Japan . |
| 38-26555 | 12/1963 | Japan . |
| 40-3415 | 2/1965 | Japan . |
| 45-16868 | 6/1970 | Japan . |
| 45-19661 | 7/1970 | Japan . |
| 46-25620 | 7/1971 | Japan . |
| 47-4131 | 2/1972 | Japan . |
| 48-29280 | 8/1973 | Japan . |
| 48-81092 | 10/1973 | Japan . |
| 48-82395 | 11/1973 | Japan . |
| 48-82396 | 11/1973 | Japan . |

*Primary Examiner*—L. Dewayne Rutledge
*Assistant Examiner*—John P. Sheehan
*Attorney, Agent, or Firm*—Seidel, Gonda, Goldhammer & Panitch

[57] ABSTRACT

A method of manufacturing a ferromagnetic metal powder by continuously drying and subsequently heat treating a slurry of ferromagnetic metal powder formed by wet reduction, characterized in that a non-oxidizing gas is supplied in separate streams to the two processes, and the non-oxidizing gas used in the drying and heat treatment is treated and recovered through separate circuits for recycling to the corresponding processes of drying and heat treatment. The separate circuits for recycling the non-oxidizing gas, the conditions in the separate two circuits are made optimum and independently adjustable so that a ferromagnetic powder of good properties is obtained.

4 Claims, 1 Drawing Figure

METHOD OF MANUFACTURING FERROMAGNETIC METAL POWDER

BACKGROUND OF THE INVENTION

This invention relates to a method of manufacturing a ferromagnetic metal powder, and more specifically to a method of manufacturing such powder for applications as magnetic recording media.

Well-known ferromagnetic powders that magnetic recording media have hitherto used include maghemite ($\gamma$-$Fe_2O_3$), cobalt-doped maghemite, magnetite ($Fe_3O_4$), cobalt-doped magnetite, iron oxide in the form of an intermediate of magnetite and maghemite, iron oxide as an intermediate of cobalt-doped maghemite and magnetite, and chromium dioxide.

Quality requirements for such media have recently become increasingly stringent, and development of ferromagnetic powders having properties adapted for recording with higher sensitivity and density is now well under way. One of the materials to which the developmental efforts are directed is the ferromagnetic metal powder. With high residual magnetism, the ferromagnetic metal powder promises wide use for high density recording media. A disadvantage is its susceptibility to oxidation due to a large overall surface area of the fine particles. The present invention provides a ferromagnetic powder imparted with excellent magnetic properties for magnetic recording media by subjection of a ferromagnetic metal powder formed by a wet reduction process to a continuous treatment for avoiding the oxidation and improving the properties of the powder.

Conventionally, ferromagnetic metal and alloy powders are made in the following ways:

(1) Thermal decomposition of an organic acid salt of a ferromagnetic metal and reduction of the resultant metal compound with a reducing gas (e.g., Japanese Pat. App. Pub. Nos. 11412/61, 22230/61, and 29280/73).

(2) Reduction of an acicular oxyhydroxide with or without other metal contents, or of an acicular iron oxide obtained from such an oxyhydroxide (e.g., Japanese Pat. App. Pub. Nos. 3862/60 and 1152/62 and Japanese Pat. App. Pub. Discl. No. 82395/73).

(3) Evaporation of a ferromagnetic metal in an inert gas at a low pressure (e.g., Japanese Pat. App. Pub. Nos. 25620/71 and 4131/72, and Japanese Pat. App. Pub. Discl. Nos. 3116/73 and 81092/73).

(4) Pyrolysis of a metal carbonyl compound (e.g., Japanese Pat. App. Pub, Nos. 1004/64, 3415/65, and 16868/70).

(5) Electrodeposition of a ferromagnetic metal powder by means of a mercury cathode and subsequent separation of the product from mercury (e.g., Japanese Pat. App. Pub. Nos. 12910/60, 3860/61, and 19661/70).

(6) Reduction of a metal salt having ferromagnetism by the addition of a reducing agent to a solution of the salt (e.g., Japanese Pat. App. Pub. Nos. 20520/63 and 26555/63 and Japanese Pat. App. Pub. Discl. No. 82396/73).

The present invention is concerned with a method of manufacturing a composition containing a magnetic metal powder suited for magnetic recording media from the magnetic metal powder obtained by the wet reduction process (6) in particular. Methods of this character, dependent on wet reduction for the supply of the starting material, have had a great difficulty in common. The wet reduction affords a product with a large water content, and it is very important to remove the water from the product in an easy and economical way without impairing the magnetic properties of the resulting powder. None of the prior art methods have, however, proved satisfactory in this respect. For the removal of water the following methods have heretofore been proposed:

(1) A hydrated ferromagnetic metal powder is washed with a solvent, such as acetone, so that the water content is replaced by the solvent. This method is disadvantageous because it requires a large quantity of the solvent and yet the water content cannot be thoroughly replaced by the solvent.

(2) A slurry formed by adding acetone to a cake of dehydrated ferromagnetic metal powder is introduced into a container, and the container is placed in a vacuum oven and kept heated at about 150° C. under reduced pressure for tens of hours (Japanese Pat. App. Pub. Discl. No. 41899/74). A problem of the method is that much time is required for the removal of water. In addition, acetone must be used.

(3) A water-containing cake of the ferromagnetic metal powder prepared by wet reduction is washed with an organic solvent, such as acetone, which is miscible with water, and then the cake is gently dried in air for the removal of water (U.S. Pat. Nos. 3,206,338 and 3,535,104, etc.) This method poses a very high possibility of fire where a large volume of the ferromagnetic metal powder is handled. The danger arises from the fact that the metal powder having a large overall surface area and which is highly reactive itself is exposed to air.

(4) A slurry of ferromagnetic metal powder formed by wet reduction is dehydrated, flaked, and fed to a dryer having a heating surface, in which the flakes are dried in an inert atmosphere by the heating surface kept at a temperature between 80° and 250° C., with agitation given for a period at least one third of the drying time (Japanese Pat. App. Pub. Discl. No. 41154/77). The method presents a problem of low productivity because it is essentially a batch treatment process. Moreover, the dehydration and flaking treatments involved necessitate a number of process steps and therefore an increased initial investment in equipment.

SUMMARY OF THE INVENTION

The present invention solves many of the aforementioned problems of the prior art methods, since it provides a magnetic metal powder suitable as such for magnetic recording media by continuously treating the ferromagnetic metal powder obtained by wet reduction, in a completely closed system, thereby dehydrating, heat treating, and stabilizing the powder without exposing it to air. The magnetic metal powder according to the invention, which is manufactured in the continuous process that permits stabilization of all the steps, displays uniform magnetic properties with minimized dispersion in quality.

Other features and advantages of the invention will become apparent from the following description taken in connection with the accompanying drawing.

According to this invention, in continuously drying and then heat treating the ferromagnetic metal powder prepared by wet reduction, the ferromagnetic metal powder is protected with a non-oxidizing gas and, by causing the non-oxidizing gas to flow through separate circuits that pass respectively the drying and heat-treating processes, the conditions of the two circuits are made optimum and adjustable. The circuits have heating sources and the non-oxidizing gas flowing through the separate circuits can serve also as a heating medium. The non-oxidizing gas circulated through the drying process dehydrates the metal powder by direct heating (as combined with the drying action of the heat supplied from the outside), and the gas thus containing a high proportion of water is freed of the water by a condenser, and then the heated gas is recycled to the drying process. On the other hand, in the heat-treating process where the humidity is low, the gas has only to be supplied with additional heat by a heater before recycling. In this manner the circuits are separately controlled with ease to operate under optimum conditions.

BRIEF DESCRIPTION OF THE DRAWINGS

The single FIGURE in the drawing is a flow sheet illustrating a preferred embodiment of the invention.

DESCRIPTION OF THE INVENTION

Figure 1:
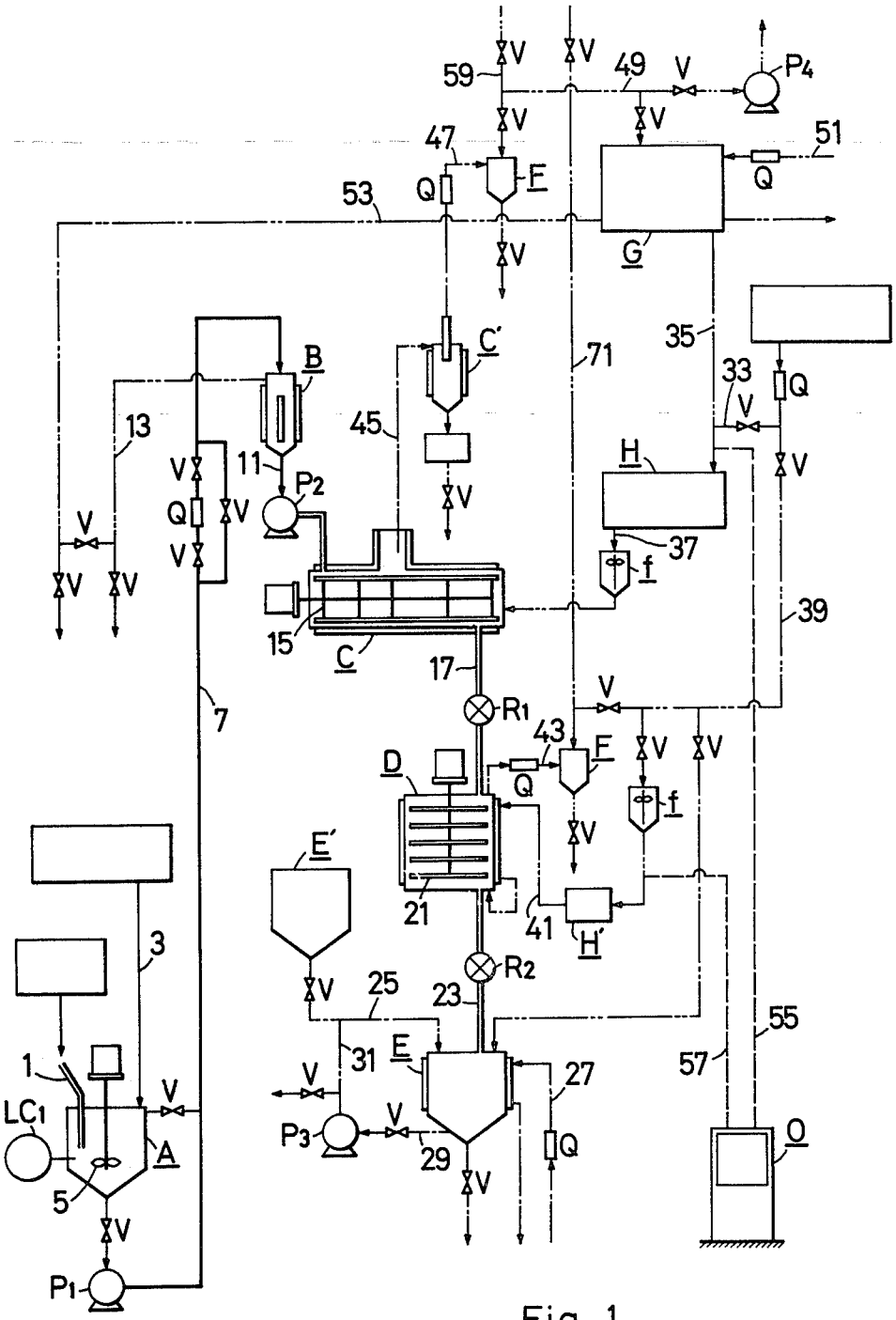

It is to be understood that the present invention lies in a method for treating a ferromagnetic metal powder prepared by wet reduction and that, for the purpose of wet reduction, any suitable method known in the art may be employed. The ferromagnetic metal powder just prepared in that way is dispersed, suspended, or settled in a solution. This invention provides a method of continuously treating such solution (hereinafter called the "solution").

Now the solution flows through a line 1 into an intermediate stock tank A, continuously or intermittently. The tank A is of a hermetically sealed construction, with a non-oxidizing gas (e.g., in the embodiment being described, nitrogen gas) sealed in to keep air off the solution in order to avoid the oxidation of the ferromagnetic metal powder. The non-oxidizing gas is supplied through a line 3. The supply source is controlled so that the pressure and volume of the non-oxidizing gas are just enough to prevent the ingress of air into the tank A, with the pressure inside kept higher than outside. Within the tank 5 are installed agitator blades 5 to avoid sedimentation of the ferromagnetic metal powder. This intermediate stock tank A functions to remove air from the solution before being sent to the next process, agitate the whole charge to a homogeneous state while driving off air from the solution, and, with its large capacity, ensure a steady outflow from the tank A so as to stabilize the flow of the solution to the subsequent processes. In this way the product is improved in quality, with the properties made uniform.

Next, the solution so controlled in flow is continuously fed through a line 7 to a settling tank B by a pump $P_1$. The intermediate stock tank A is equipped with a level controller $LC_1$, which senses the solution level at all times and, when the quantity of the solution in the tank has decreased below a predetermined level, causes the pump $P_1$ to stop, discontinuing the transfer of the solution to the settling tank B. The settling tank B allows the ferromagnetic metal powder in the solution to settle down by gravity, forming a slurry of the ferromagnetic metal powder so as to enhance the efficiency of the drying process that follows. The settling tank B is connected at the bottom with a slurry discharge line 11, and at the top with a line 13 for taking out separated water. Through the latter a substantial portion of water is removed from the solution to slurry the ferromagnetic metal powder, thus increasing the efficiency and reducing the energy load in the ensuing process of drying. While the retention of the solution in the settling tank can easily be timed empirically in relation to the settling rate of the ferromagnetic metal powder, that of the solution containing the powder for magnetic recording media may usually last from about 10 minutes at most to about 3 minutes at a minimum. To avoid oxidation, it is desirable that the retention time be as short as possible. The slurry thus concentrated by settling is drawn out by a pump $P_2$ into a line 11 and thence into a dryer C at a predetermined rate of flow. On the other hand, excess water is overflown from the top of the tank into a line 13 for reuse.

The dryer C is provided with a heating jacket, through which steam or other heating medium is circulated. Although heating up to 300° C. is possible, the temperature inside the dryer is ideally kept under 250° C. The heat to maintain this inside temperature is supplied not only from the jacket but also from the non-oxidizing gas. The hot non-oxidizing gas from a heater H is continuously supplied to the dryer C., in which it applies heat while flowing counter-currently to the ferromagnetic metal slurry, which in turn is being forced toward the outlet end (from left to right as viewed in the drawing) of the vessel with agitation by rotary agitator-conveyor blades 15. Thus, as it moves from the inlet to the outlet of the dryer C, the slurry is gradually dried, the dry powder surface being protected by the non-oxidizing gas. The rotary blades 15 may be set to a desired rotational speed, up to about 6 rpm. In addition to the conveyance of the slurry as above described, the blades increase the drying efficiency and prevents sintering of the particles. In this way, the ferromagnetic metal powder under the protection of the inert atmosphere is divided into independent, discrete particles, which can display desirable properties as magnetic particles.

The ferromagnetic metal powder, now completely free of water and under the protection of the non-oxidizing gas, is led out of the dryer C into a line 17 and thence into a heat-treating unit D via a rotary valve $R_1$. The unit D is likewise supplied with the non-oxidizing gas. The outer wall of the unit D is covered with a heating jacket, which enables the temperature inside the unit to be controlled up to 300° C. This heat-treating unit is intended to adjust the magnetic properties of the ferromagnetic metal powder, and especially to increase the coercive force Hc, so that the powder may be advantageously used in the manufacture of high density recording media. For this ferromagnetic metal powder the retention time in the heat-treating unit D is between about one and 30 minutes, preferably in the proximity of 5 minutes. To assure uniform heat treatment, the unit D also employs agitator blades 21.

After the heat treatment the ferromagnetic metal powder is continuously drawn out of the unit by a rotary valve $R_2$ into a line 23 leading to a product tank E for temporary storage before delivery. The metal powder entering the tank E, which catches fire easily on contact with oxygen, is protected against the fire hazard by the non-oxidizing gas. This metal powder, if brought into contact with air during the course of mixing with a binder resin for the making of a magnetic recording medium, would rapidly oxidize or have danger of ignition. The product tank E for subsequent delivery is a unit for avoiding such danger by impregnating the ferromagnetic metal powder with a solvent for oxidation prevention (e.g., toluene, in this embodiment). To attain the end, toluene or other solvent is stored in a tank E' and is sent through a line 25 to the tank E at the top. Since the ferromagnetic metal powder is supplied hot, the tank E is fitted with a cooling jacket over the outer wall to cool the powder with tap water or the like 27 at 25° C. or below to avoid the temperature rise. The flow rate of the cooling water is controlled by a flow meter Q. Although it is preferable to cool the powder as soon as it leaves the outlet of the heat-treating unit D, it would call for an unduly large space when the cooling time and other factors were taken into account. In the present embodiment, therefore, economy in space is achieved by cooling the powder while, at the same time, impregnating it with the solvent.

Following the impregnation and protection with the solvent, the ferromagnetic metal powder is taken out by a pump $P_3$ into a line 29 for an ensuing process. The next process, which is not relevant to the subject matter of this invention, is a conventional one for preparing a magnetic coating for the manufacture of a magnetic recording medium. In that stage the solvent-coated ferromagnetic metal powder is mixed and kneaded with a resin binder and a solvent. Because the magnetic powder obtained in accordance with this invention is protected with the solvent, the process of preparing the coating may be operated batchwise. The pump $P_3$ is shown as serving also for the supply of the solvent from the tank E' to the tank E, and further for the merging with the solvent from the tank E' (through a line 31), although such a combined use of the pump is a matter of free choice.

Next, the system for supplying and circulating the non-oxidizing gas to the individual processes will be explained. While it has already been stated with reference to the drawing that the non-oxidizing gas is supplied to the dryer C and the heat-treating unit D, the two units use totally different routes for the gas supply and circulation. The circulation is intended to minimize the consumption of the non-oxidizing gas but, because the streams of gas leaving the dryer C and the heat-treating unit D differ widely in the water content, they cannot be thoroughly dehumidified by passage through a common condenser. For this reason the present embodiment uses two separate circuits, thus avoiding a decline in the operation efficiency as well as an increase in equipment cost due to the addition of a separate dehumidifier.

The non-oxidizing gas (nitrogen) is supplied through a line 33 to a heater H. The gas taking this route is mostly recycled from a line 35, and only a minor supply of fresh gas is necessary for the makeup purpose, so that the gas streams are combined and heated together in the heater H. After the heater has heated the incoming gas to a temperature about as high as in the dryer C, the hot gas is forced to the outlet of the dryer by a fan f in a line 37. The heating means of the heater H may be freely chosen, namely, electricity, steam heating medium, or other desirable means. In the present embodiment a chemical heating medium is employed. The gas led into the dryer C heats and dehydrates the slurry of ferromagnetic metal powder therein in the manner already described. The non-oxidizing gas, thus laden with a large proportion of water, is taken out through a line 45 to a cyclone C', where the metal powder carried by the gas is first separated out, and the remaining hot gas is transferred to a condenser G through a lne 47, filter F, and line 49. Through the condenser G is circulated cooling water from a line 51 to effect dehumidification of the non-oxidizing gas. The resulting water is recovered through a line 53, and the dehumidified gas is recycled in the manner above described.

In the meantime, for the supply of the non-oxidizing gas to the heat-treating unit D, a minor supply of makeup gas from the source through a line 39 and a major supply being recycled from the heat-treating unit D are caused to pass together through a fan f in the line and a heater H' into the jacket of the unit D. The non-oxidizing gas flows down through the jacket and enters the heat-treating unit D at the outlet so as to transfer its heat to the powder being heat treated therein, while providing a protection against oxidation. The gas leaves the unit D at the powder inlet into a line 43 and thence into a filter F, where it is freed of the ferromagnetic metal powder it carried and then is recycled to the heater H' in the afore-said manner.

In the system according to the invention, the dryer C and the heat-treating unit D are designed each to hold the ferromagnetic metal powder in a dehydrated state, and therefore the atmosphere surrounding the powder must not contain oxygen beyond a certain degree (explosive limit). To meet this requirement, an oxygen concentration detector O for controlling the oxygen concentrations in the dryer C and the heat-treating unit D is connected to the inlets of the heaters H and H' via lines 55, 57, respectively. The detector O monitors the oxygen concentrations and, if either value has exceeded a predetermined concentration (set to 25% of the explosive limit in the present embodiment), it automatically causes the non-oxidizing gas to be driven off the system and replaced by fresh gas. For example, the detector O may be designed so that, in such an event, it actuates valves V in lines 59, 71 to effect the gas discharge and also actuates valves V in lines 33, 39 for the introduction of fresh gas. In this way safety of the system against explosion, fire and other hazards is secured.

What we claim is:

1. A method of manufacturing a ferromagnetic metal powder by continuously drying and subsequently heat treating a slurry of ferromagnetic metal powder formed by wet reduction, characterized in that a non-oxidizing gas is supplied in separate streams to the drying and heat treating processes, the streams of non-oxidizing gas used in the drying and heat treating processes are treated and recovered through separate circuits for recycling to the respective processes of drying and heat treating, and continuously stabilizing the heat-treated ferromagnetic metal powder with a solvent for preventing oxidation.

2. A manufacturing method according to claim 1, in which said non-oxidizing gas in the circuit through the drying process contacts and dehydrates the ferromagnetic metal powder in said drying process, flows out of said process to be treated and freed from water by a condenser, and then the dry non-oxidizing gas thus treated and recovered is heated and recycled to said drying process.

3. A manufacturing method according to claim 1 or 2, in which said non-oxidizing gas flowing through the heat-treating process is recycled by way of a heater.

4. A manufacturing method according to claim 3, in which said streams of non-oxidizing gas flowing through the respective processes contain minor portions of makeup gas and major portions of recycled gas.

* * * * *